US007540221B1

(12) United States Patent
Schmidt

(10) Patent No.: US 7,540,221 B1
(45) Date of Patent: Jun. 2, 2009

(54) EXACT WEIGHT CUTTING AND DESTACKING SYSTEM FOR FOOD PRODUCTS

(75) Inventor: Richard F. Schmidt, Fond du Lac, WI (US)

(73) Assignee: Marchant Schmidt, Inc., Fond du Lac, WI (US)

( * ) Notice: Subject to any disclaimer, the term of this patent is extended or adjusted under 35 U.S.C. 154(b) by 474 days.

(21) Appl. No.: 11/286,596

(22) Filed: Nov. 23, 2005

Related U.S. Application Data

(60) Provisional application No. 60/684,115, filed on May 24, 2005.

(51) Int. Cl.
*B26D 1/553* (2006.01)

(52) U.S. Cl. ..... 83/39; 83/35; 83/651.1; 83/932

(58) Field of Classification Search ..... 83/39, 83/75.5, 107, 151, 152, 407, 408, 932, 47, 83/77, 35, 36; 426/518, 582; 99/585, 587, 99/588, 592; 425/140
See application file for complete search history.

(56) References Cited

U.S. PATENT DOCUMENTS

| | | | | |
|---|---|---|---|---|
| 1,931,982 | A * | 10/1933 | Faillers | 83/212.1 |
| 3,200,864 | A | 8/1965 | Gillman | |
| 3,204,676 | A | 9/1965 | Gillman | |
| 3,510,944 | A * | 5/1970 | Johanski, Jr. | 83/14 |
| 3,636,630 | A | 1/1972 | Budahn | |
| 4,208,931 | A * | 6/1980 | Collins | 83/44 |
| 4,318,321 | A * | 3/1982 | De Mattos | 83/75.5 |
| 4,608,896 | A | 9/1986 | Topp | |
| 4,646,602 | A | 3/1987 | Bleick | |
| 4,991,477 | A | 2/1991 | Butt et al. | |
| 5,784,937 | A | 7/1998 | Wygal et al. | |
| 6,164,174 | A | 12/2000 | Sigurdsson et al. | |
| 6,468,570 | B1 | 10/2002 | Haddad et al. | |
| 6,487,949 | B1 | 12/2002 | Dharia | |
| 6,549,823 | B1 | 4/2003 | Hicks et al. | |
| 6,655,248 | B1 * | 12/2003 | Johnson | 83/47 |

FOREIGN PATENT DOCUMENTS

| | | |
|---|---|---|
| DE | 4218267 | 12/1993 |
| DE | 19820058 | 12/1999 |

* cited by examiner

*Primary Examiner*—Boyer D. Ashley
*Assistant Examiner*—Laura M. Lee
(74) *Attorney, Agent, or Firm*—Reinhart Boerner Van Deuren S.C.

(57) ABSTRACT

A system for cutting blocks of cheese or other food product into chunks includes conveyors for moving the blocks along an automated, continuous, in-line processing path. A block cutter cuts the blocks longitudinally and or vertically to provide one or more stacks of slabs which are destacked by a vacuum transfer apparatus. A transverse cutter cuts the individual slabs to create chunks of cheese or other food product. The conveyors include a stack conveyor located in the processing path for conveying successive stacks of slabs from the block cutter to the product destacking apparatus in succession, and a slab conveyor located in the processing path for conveying successive slabs from the product destacking apparatus to the transverse cutter. A trim cutting module includes a rotating mechanism that rotates a block during the trim operation, allowing trim to drop to a trim disposal conveyance.

8 Claims, 16 Drawing Sheets

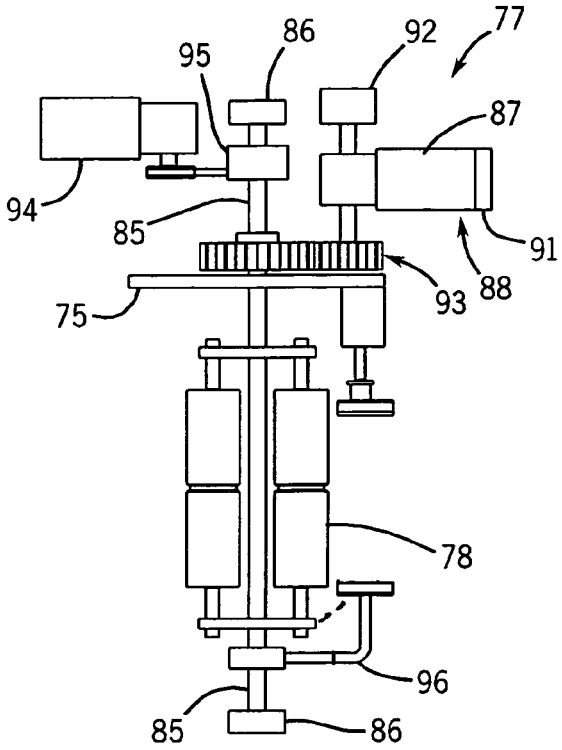
FIG. 10
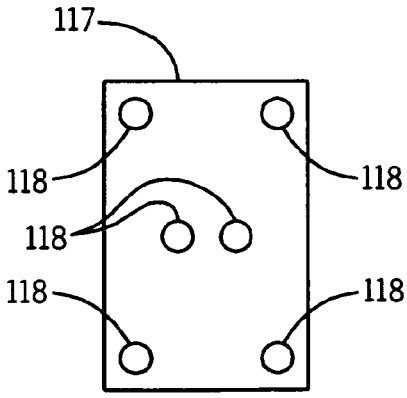
FIG. 11
FIG. 12
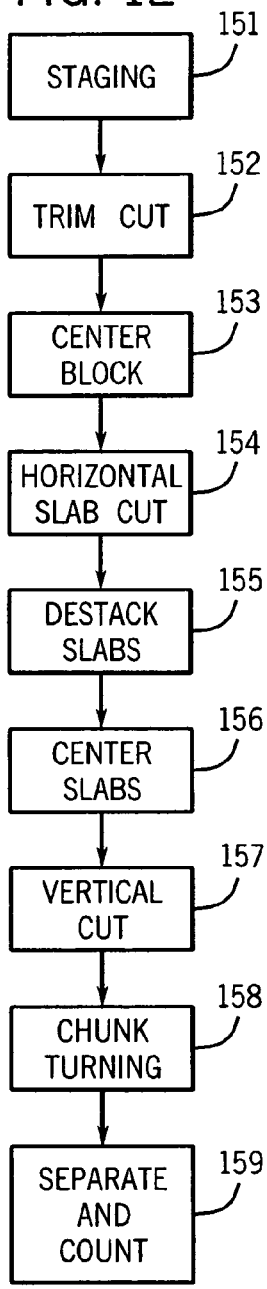

15/16

EXACT WEIGHT CUTTING AND DESTACKING SYSTEM FOR FOOD PRODUCTS

CROSS REFERENCE TO RELATED APPLICATION

This application claims priority of provisional application Ser. No. 60/684,115, which is entitled "Exact Weight Cutting and Destacking System For Food Products", and which was filed on May 24, 2005, the entirety of which is hereby incorporated herein by reference.

BACKGROUND OF THE INVENTION

Field of the Invention

The present invention relates generally to systems and methods for cutting large blocks of a food product, such as cheese, into smaller portions suitable for packaging.

Many food products, such as cheese, are produced in block-form and a multi-stage cutting operation is used for cutting the blocks into smaller portions for retail sale. In conventional processing of large blocks of cheese, for example, a block of cheese is cut horizontally into a plurality of slabs.

The slabs produced by the horizontal cutting operation are separated and cut vertically into a plurality of strips which are cut into individual portions or chunks of shorter lengths for packaging. After cutting, the individual portions typically stick together, and separation of the individual portions is done manually or under manually supervision.

One known system for cutting blocks of a food product, such as cheese, into smaller portions for packaging is disclosed in U.S. Pat. No. 6,549,823, which issued on Apr. 15, 2003 and which is assigned to Marchant Schmidt, Inc. of Fond Du Lac, Wisconsin. The system includes a first cutting station for cutting blocks of cheese horizontally into a plurality of slabs of cheese, a second cutting station for cutting the slabs of cheese vertically into a plurality of bars and a third cutting station for cutting the bars in to smaller portions for packaging. The first and second cutting stations include harp cutters. The third cutting station includes a guillotine cutter. No rotational or lateral movements of the cheese are involved at any stage during the cutting process.

The system includes a slab separation arrangement between the first and second cutting stations. The slab separation arrangement includes a height-adjustable platform for supporting a stack of slabs and a layer-selective pusher for pushing the topmost slab off of the stack and into and through the second-stage harp cutter. The destacking operation includes raising the platform incrementally, pushing the slabs off of the platform in succession, lowering the platform, and reloading the platform with a further stack of slabs. The conveying system must be stopped during the destacking operation.

In the embodiment disclosed, the slabs of cheese are cut vertically into four, side-by-side bars the longitudinal axes of which extend in the conveying direction. This results in sets of four portions of cheese after cutting the bars with the guillotine cutter. The individual portions are weighed for monitoring adherence to prescribed weight standards, to provide exact weight product. In one embodiment, the system employs scales to weigh the blocks. In an alternative arrangement, the weight of the end product is determined by monitoring the size of the portions during the cutting process. Thus, this system requires the use of scales and/or measurements for providing control information used by a control processor for adjusting process operations to maintain a desired weight for the end product.

It is accordingly the primary objective of the present invention that it provide an improved system and method for cutting large blocks of food product into smaller portions suitable for packaging.

It is another objective of the present invention that it provide an automated, continuous, in-line production process for cutting large blocks of food product into smaller portions suitable for packaging.

It is another objective of the present invention that it provide a block cutting system and method for high speed applications.

Another objective of the present invention is that it provide a system and method for cutting large blocks of food product into smaller portions and which employ vacuum transfer technology and ultrasonic cutting.

The system of the present invention must include apparatus of construction which is both durable and long lasting, and it should also require little or no maintenance to be provided by the user throughout its operating lifetime. In order to enhance the market appeal of the apparatus of the present invention, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, there is provided a system and method for cutting large blocks of cheese or other food product into smaller portions suitable for packaging.

In accordance with the invention, a system for cutting blocks of cheese or other food product, into smaller portions includes conveyors adapted to receive incoming blocks of the product and move the blocks along a continuous, in-line processing path for cutting. A block cutting system includes a block cutter for making one or more longitudinal cuts, dividing the width and/or depth of a block on the processing path to provide at least one stack including a plurality of slabs of the product. A product destacking apparatus for destacking the stack of slabs to provide individual slabs and for transferring the individual slabs to a slab separation conveyor, the slab separation conveyor temporarily holding the individual slabs. The product destacking apparatus includes a vacuum transfer apparatus for lifting individual slabs off the stack in destacking the stack of slabs. A slab cutting system includes a transverse cutter for cutting the individual slabs to create chunks of the product. The conveyors include a product destacking and infeed conveyor for conveying stacks of slabs from the block cutter to the product destacking apparatus and a product holding conveyor for conveying slabs from the product destacking apparatus to the transverse cutter.

Further in accordance with the invention, a system for cutting blocks of cheese or other food product into chunks includes conveyors for conveying the blocks of the product in a conveying direction along a processing path for cutting. The system includes a trim cutting module for cutting trim from a block during a trim cutting operation. The trim cutting module includes a mechanism for rotating the block away from a conveying position to a trimming position to allow trim cut from the block to drop to a trim disposal conveyance and for rotating the block back to the conveying position, after trim has been cut from the block, to allow the block to continue to be conveyed along the processing path for further cutting operations. A block cutting system includes a block cutter for making one or more longitudinal cuts in the block, as the block is moved in the conveying direction, to divide the width and/or depth of the block into a plurality of individual slabs. A slab cutting system includes a transverse cutter for cutting the individual slabs to create a plurality of chunks of the product.

In accordance with the invention, the block is rotated away from the conveying direction. After rotation, the trim is cut. By way of an non-limiting example, the trim removal module can rotate a block of the product being trimmed about 180° about an axis that extends perpendicular to the conveying direction.

In accordance with the invention, a method for cutting blocks of cheese or other food product into chunks includes the steps of conveying the blocks of the food product along a processing path for cutting the blocks; making one or more longitudinal cuts in a block to create at least one stack including a plurality of slabs of the product; conveying the stack of slabs to a vacuum transfer apparatus; using the vacuum transfer apparatus to destack the stack of slabs to provide a plurality of individual slabs, including controlling the vacuum transfer apparatus to successively lift slabs from the stack for transfer to a slab separation conveyor; conveying the individual slabs in succession from the slab separation conveyor to a slab cutting system that includes a transverse cutter; and using the slab cutting system for cutting the individual slabs to create the chunks of the product.

Further in accordance with the invention, a method for cutting a block of cheese or other food product into chunks includes the steps of conveying the blocks of the product in a conveying direction along a processing path for cutting the blocks; cutting trim from the block, including rotating the block away from a conveying position to a trimming position to allow the trim cut from the block to drop to a trim disposal conveyance; cutting the block to create at least one stack including a plurality of slabs of the product; destacking the stack of slabs; and cutting the slabs to provide a plurality of chunks of the product.

Advantages of the invention include providing a high speed block cutting application that produces a large chunk output. By way of example, the system can produce 150-200 chunk pieces per minute. The system according to the invention also automates of an existing labor intensive process, while achieving low trim and give away. Moreover, the use of vacuum transfer technology, including ultrasonic cutting, a high speed block cutting application contributes to producing exact weight chunks of the product without the need for weighing the food product during the block cutting operations.

It may therefore be seen that the present invention teaches a system and method for cutting large blocks of a food product, such as cheese, into smaller portions suitable for packaging for retail sale. The system employs an automated, continuous, in-line production process in cutting large blocks of food product into smaller portions suitable for packaging.

The system of the present invention includes apparatus that is of a construction which is both durable and long lasting, and which will require little or no maintenance to be provided by the user throughout its operating lifetime. The apparatus in accordance with the invention is also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which:

FIG. 10 is a plan view of a pivot drive mechanism of the top trim module of FIG. 2A;

FIG. 11 is a bottom plan view of a vacuum transfer plate assembly of a slab destacking module of the apparatus of FIG. 2;

FIG. 12 is a block diagram of the process for cutting blocks in accordance with the invention;

FIGS. 2A, 2B and 3 are to be arranged;

FIGS. 4A, 4B and 5 are to be arranged;

DETAILED DESCRIPTION OF THE PREFERRED EMBODIMENT

Figure 1:
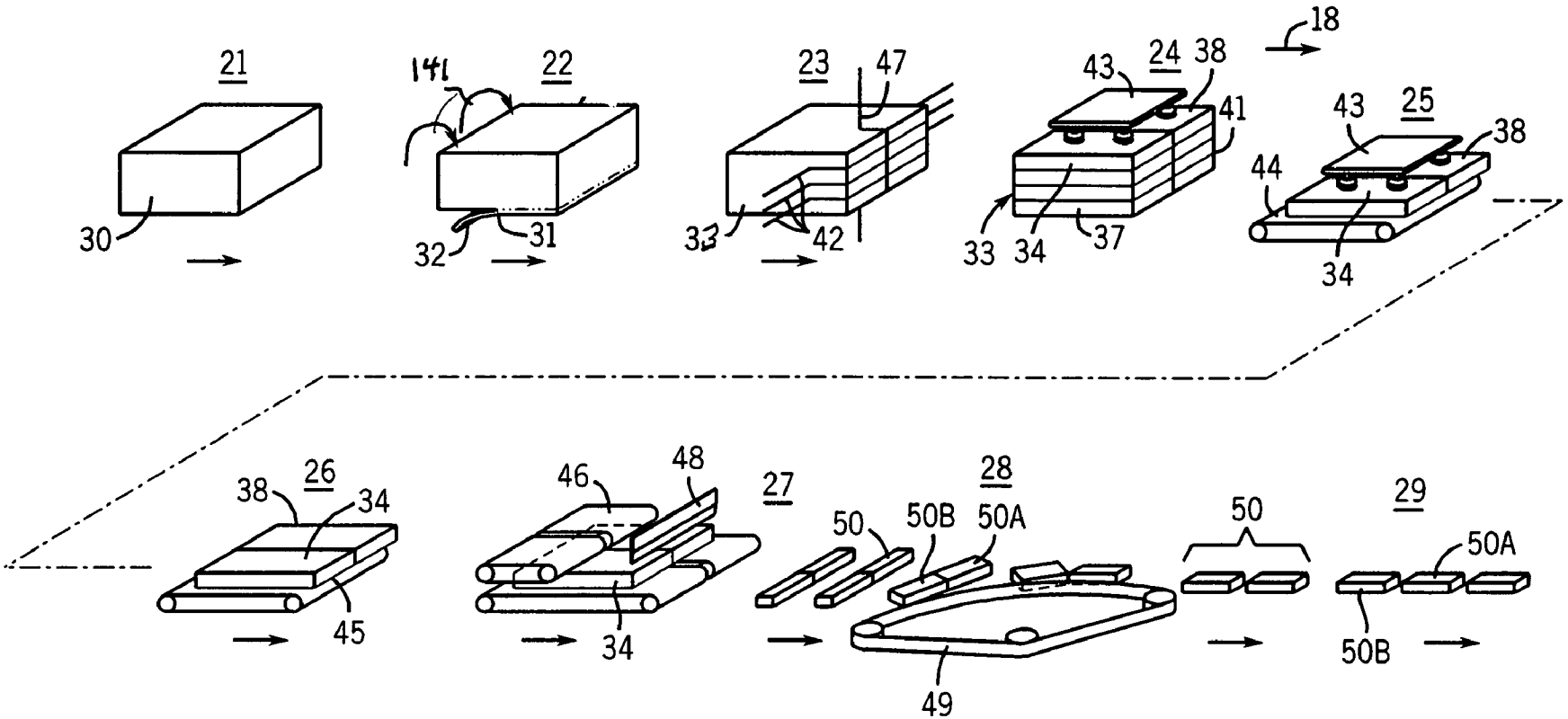
FIG. 1 is an isometric representation of a process for cutting blocks of cheese or other food product in accordance with the invention.

Referring to FIG. 1, there is shown a simplified representation of a process for cutting large blocks of a food product into smaller portions. By way of illustration and without limitation, the process is described with reference to an application for cutting blocks of hard cheese produced by a cheese production process into smaller portions or chunks of cheese suitable for retail packaging. The person skilled in the art will understand that cheese blocks come in a variety of shapes and sizes according to the kind of cheese, the method of manufacture, the country of manufacture and so forth. The process illustrated can be used for cutting, for example, a forty or 20 pound block of cheese down into ultimate portions or chunks of 250 grams each, or some other weight suitable for retail in packaged form. However, with suitable modification of the cutting apparatus in a way apparent to those skilled in the art, blocks of cheese or other food product of other sizes, shapes and weights can be processed. The number of chunks obtained from a given block is a function of the size of the block of cheese as well as the configuration of the cutting apparatus. By way of example, in one embodiment, thirty-two chunks of cheese will be produced from a forty pound block and sixty-four chunks of cheese will be produced from a eighty pound block.

The Cutting Process

Referring to FIG. 1, this is an automated, continuous, in-line process with the blocks to be cut being moved along a linear processing path in a conveying direction 18 indicated by the arrows. The cutting process in accordance with the invention includes nine stages, namely: an infeed stage 21;

a trim removal stage 22;
a first cutting stage 23;
a product destacking stage 24;
a product holding stage 25;
a product centering stage 26;
a second cutting stage 27;
a product denesting stage 28; and
a portion accumulation stage 29.

Briefly, the infeed stage 21 is a staging area for the process, receiving blocks 30 to be cut into smaller portions. The blocks are conveyed to the trim removal stage 22 which includes a trim cutter 31 that removes trim 32 from the blocks providing a trimmed block 33. The first cutting stage 23 cuts trimmed blocks horizontally and vertically into a plurality of slabs 34-37 and 38-41 disposed in two stacks as shown at the product destacking stage 24. The product destacking stage 24 unstacks the slabs and conveys the individual slabs to the product holding stage 25. The product holding stage 25 receives the individual slabs 34-37 and 38-41 in sequence and conveys the slabs to the product centering stage 26. The product centering stage 26 transfers the individual slabs from the product holding stage 25 to the second cutting stage 27. The second cutting stage 27 cuts the slab portions into sets 50 of chunks of the food product. The product denesting stage 28 reorients the sets 50 of chunks longitudinally and conveys the chunks 50A and 50B in a single file to the portion accumulation stage 29. The portion accumulation stage 29 separates and spaces the chunks into individual chunks 50A and 50B and counts the chunks prior to packaging.

More specifically, in the infeed stage 21, a plurality of blocks of cheese, such as block 30 (shown as block 51 in FIG. 2), to be processed are placed on a staging conveyor 72 shown in FIG. 2. The blocks of cheese are conveyed one at a time in the conveying direction 18 from the staging conveyor to the trim removal stage 22.

The trim removal stage 22 includes a cutter 31, such as a spring-tension wire, that cuts trim 32 from the top portion of the blocks of cheese received from the infeed stage 21, forming a trimmed block 33. During the trim cutting operation, the block that is being trimmed is rotated, in the direction of the arrows 141, about an axis that is perpendicular to the conveying direction. By way of example, the block 30 being processed is rotated 180° in the conveying direction (end over end). This allows the trim 32 to drop into a trim pan 71 (FIG. 6) for subsequent disposal. Once the block is inverted upside down (or 180° from original position), the cutter wire 31 is pushed through the block 30 of cheese to cut the trim. The trimmed block 33 is rotated in the opposite direction back to the original or conveying position.

Then, the trimmed block 33 is conveyed to the cutting stage 23 where the trimmed block 33 is cut into a plurality of slabs. The cutting stage 23 includes a horizontal cutter 42 for cutting the block horizontally to form a stack of slabs and a vertical cutter 47 for cutting the stack into two stacks. The vertical cutter 47 cuts each block into two equal block portions each including a plurality of slabs. For example, four horizontally cut slabs cut vertically will yield eight horizontally cut slabs, at half the original width. There are also vertical trim wires (not shown) to eliminate excessive width to the block. The trim 32 just falls away to a trim pan for disposal. The horizontal cutter 42 can include one or more horizontally mounted cutter wires, a horizontally oriented blade movable to make the desired cuts, or any other suitable cutting device. Preferably, the horizontal cutter 42 is a cutter wire assembly. The vertical cutter 47 can be a cutting wire, a blade or any other suitable cutting device, and is preferably a cutter wire. In the exemplary embodiment, each block is cut by the vertical cutter 47 into two stacks, with one stack including four slabs 34-37 and the other stack including four slabs 38-41. However, the block can be cut into more or fewer depending slabs, for example, depending upon the size of the block being cut, the number and size of the chunks to be produced from a each block, etc.

The two stacks of slabs 34-37 and 38-41 are conveyed to the product destacking stage 24, including a separation apparatus 43 which separates the slabs 34-37 and 38-41 from the two stacks, in sequence. Preferably the separation apparatus includes a vacuum separation apparatus. The individual slabs 34-37 and 38-41 are transferred to a product holding conveyor 44 in the product holding stage 25 which holds the slabs 34-37 and 38-41 prior to the slabs being conveyed in succession to the second cutting stage 27.

In the product centering stage 26, each pair of slabs, such as slabs 34 and 38, is centered prior to further cutting and is held momentarily until the vertical cutter 48 of the second cutting stage 27 has completed its current cutting cycle. Then, the pair of slabs 34 and 38 is conveyed by a transfer conveyor 45 that transfers the slabs 34 and 38 to the second cutting stage 27.

The second cutting stage 27 includes a hold-down conveyor 46 that moves the slabs through the second cutting stage 27. The slabs 34 and 38 are cut simultaneously by a transverse cutter 48 to form sets 50 of chunks 50A and 50B of cheese.

The sets 50 of chunks of cheese are conveyed to the product denesting stage 28 which includes a turning belt 49 that changes the orientation of the pairs of chunks. The sets of chunks are re-oriented into a single evenly-spaced file for feeding to an automated packaging machine.

Finally, the chunks 50A and SOB of cheese are advanced to the portion accumulation stage 29. The portion accumulation stage 29 includes apparatus for separating the chunk sets 50 into separate chunks 50A and 50B, spacing the chunks 50A and 50B apart from one another, and counting the chunks 50A and 50B prior to packaging.

Processing Apparatus

Figure 2A:
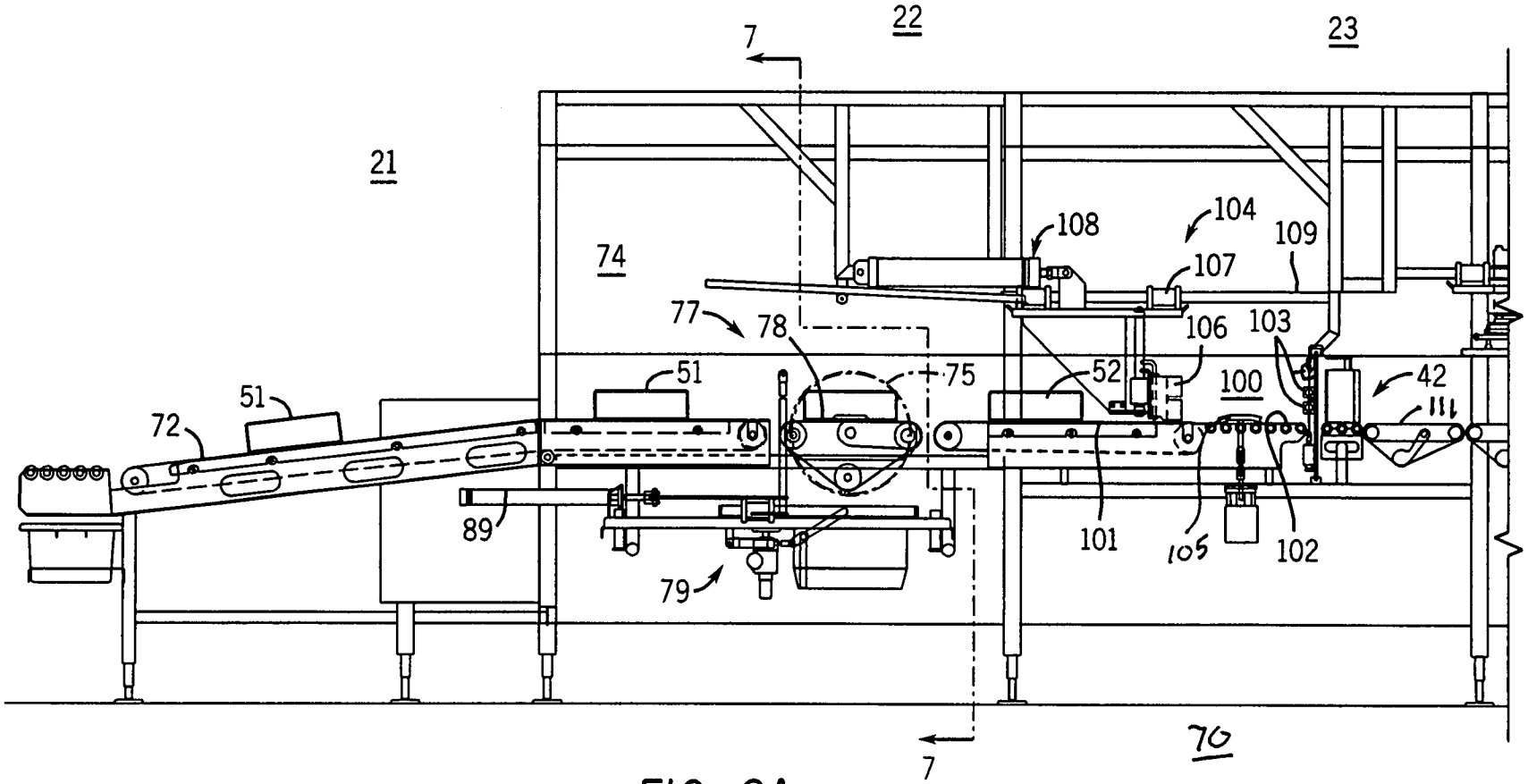
FIGS. 2A, 2B and 3, when arranged in side-by-side relation as shown in FIG. 17, are a side elevation view of apparatus of a system for cutting blocks of cheese or other food product in accordance with the invention.
Figure 2B:
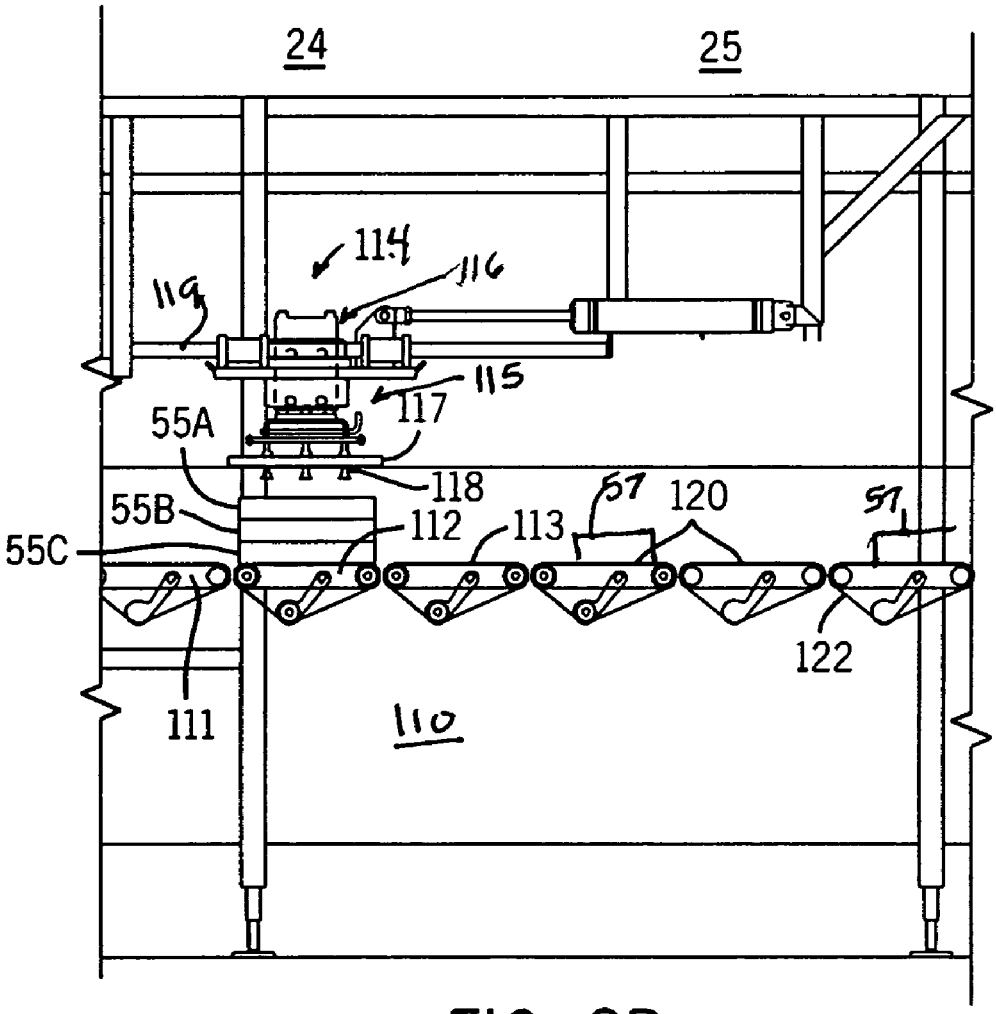
Figure 3:
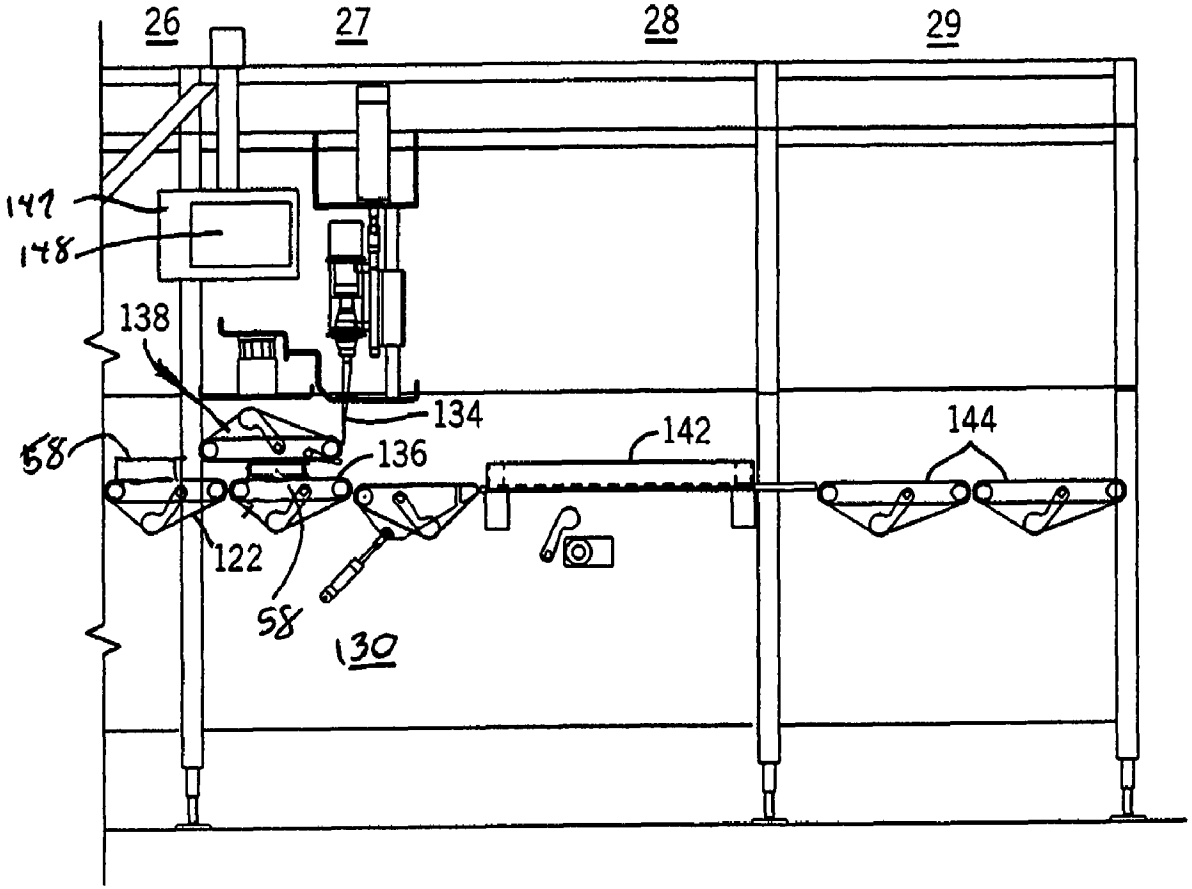
Figure 4A:
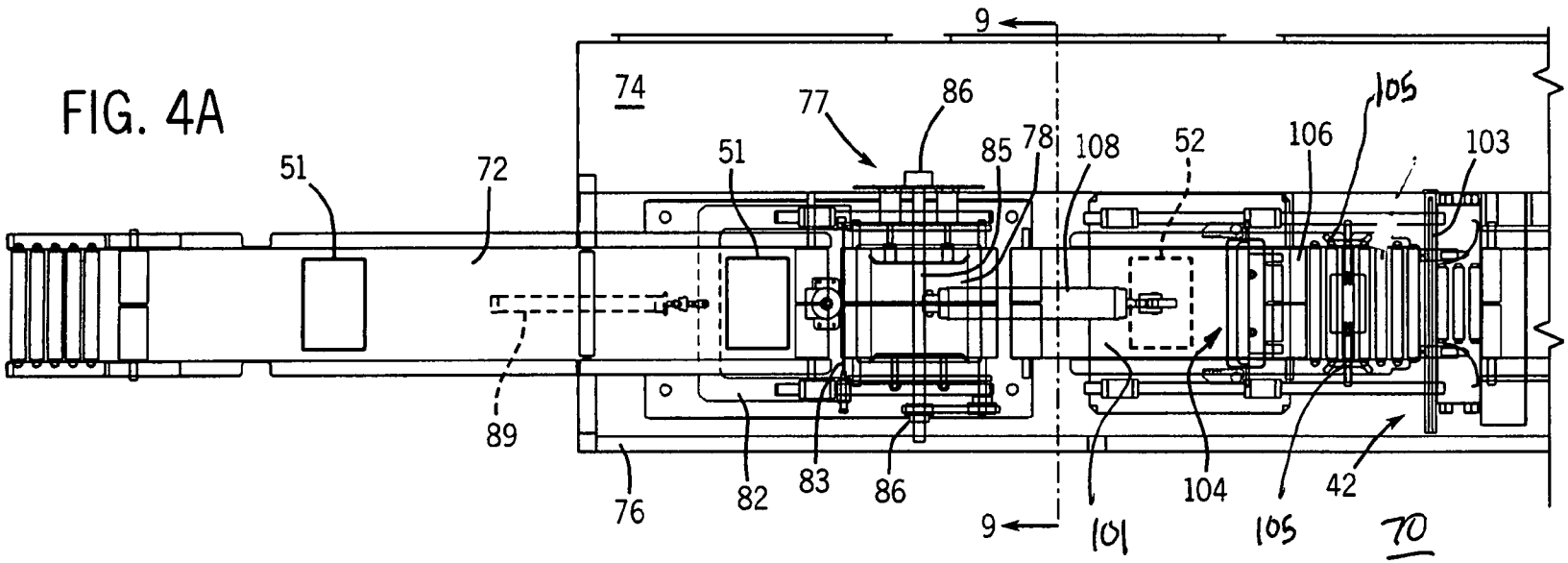
FIGS. 4A, 4B and 5, when arranged in side-by-side relation as shown in FIG. 18, are a top plan view of the apparatus of FIGS. 2A, 2B and 3.
Figure 4B:
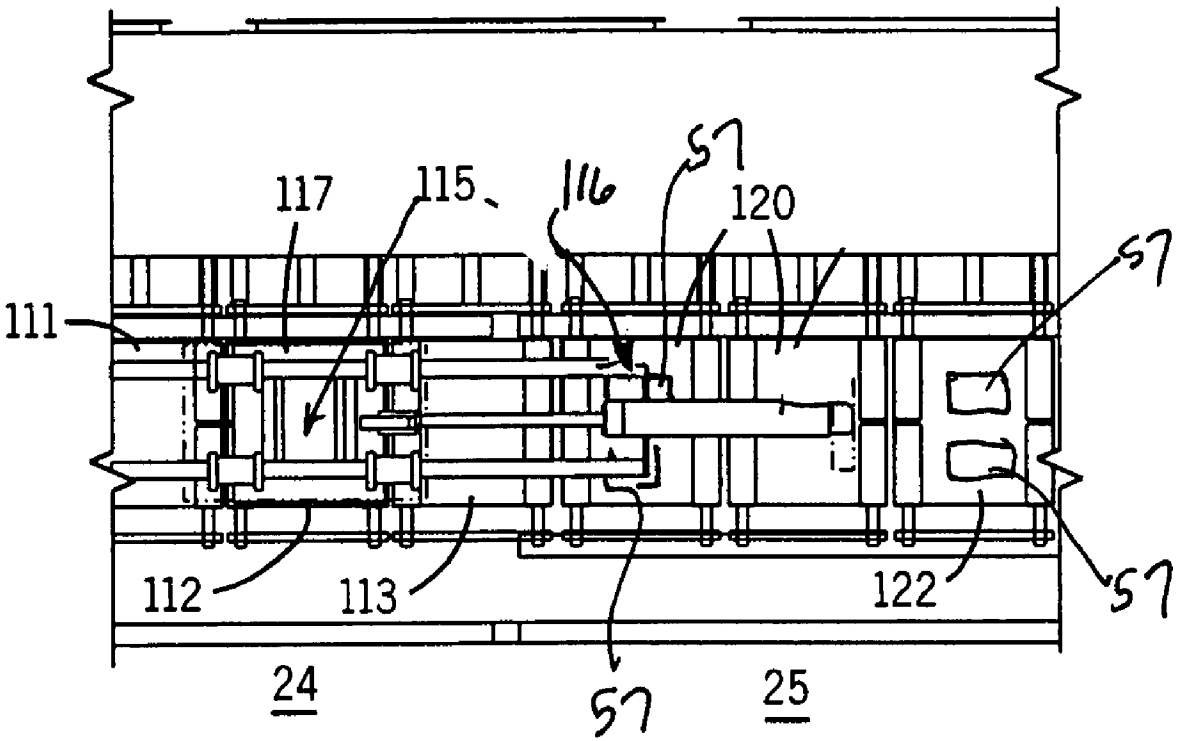
Figure 5:
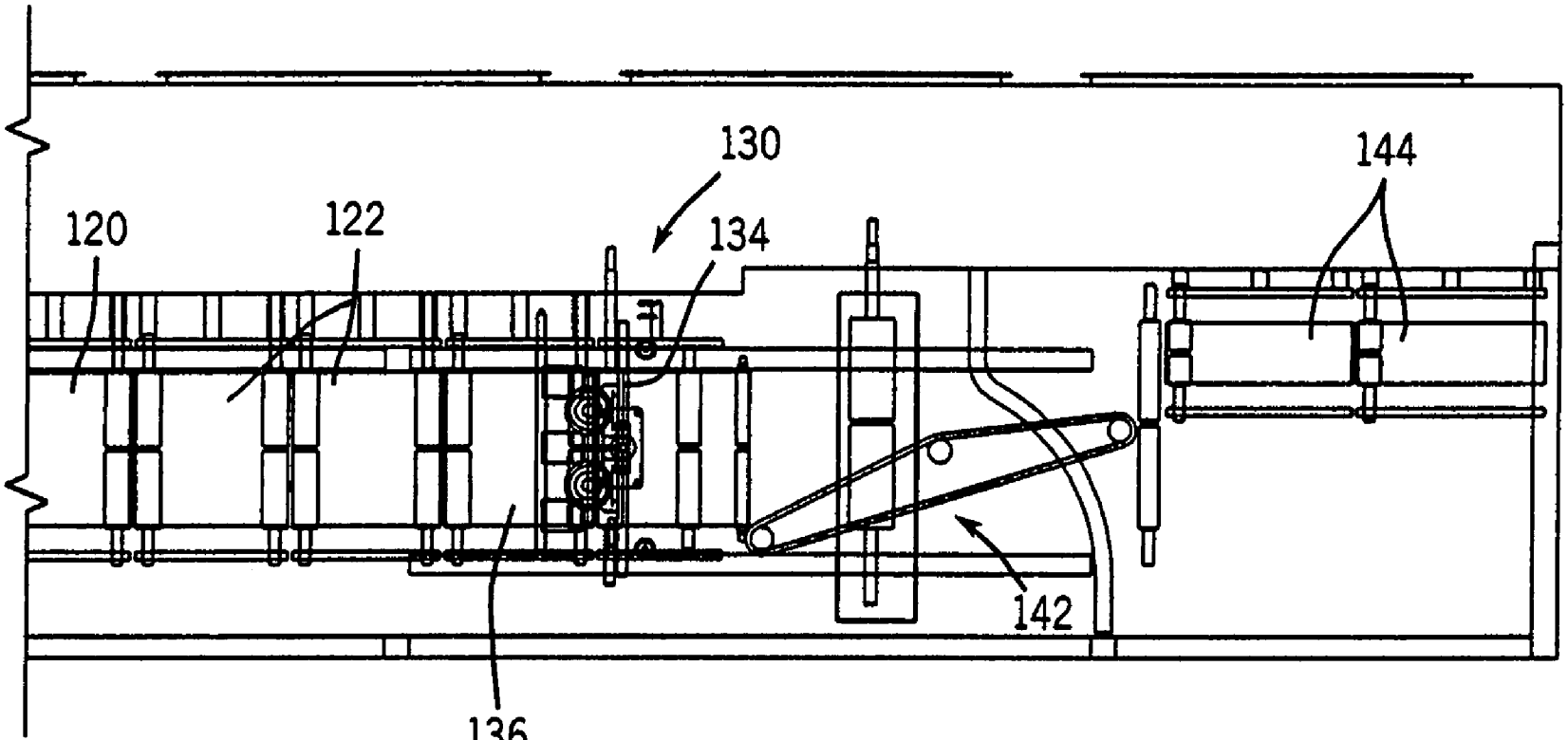
Figure 17:
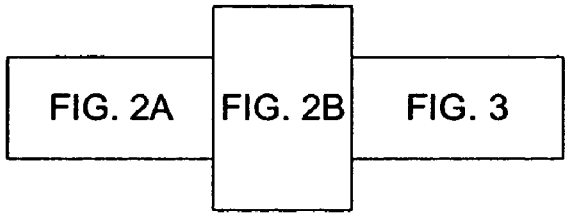
FIG. 17 shows how
Figure 18:
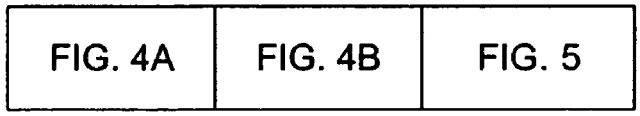
FIG. 18 shows how
Figure 19:
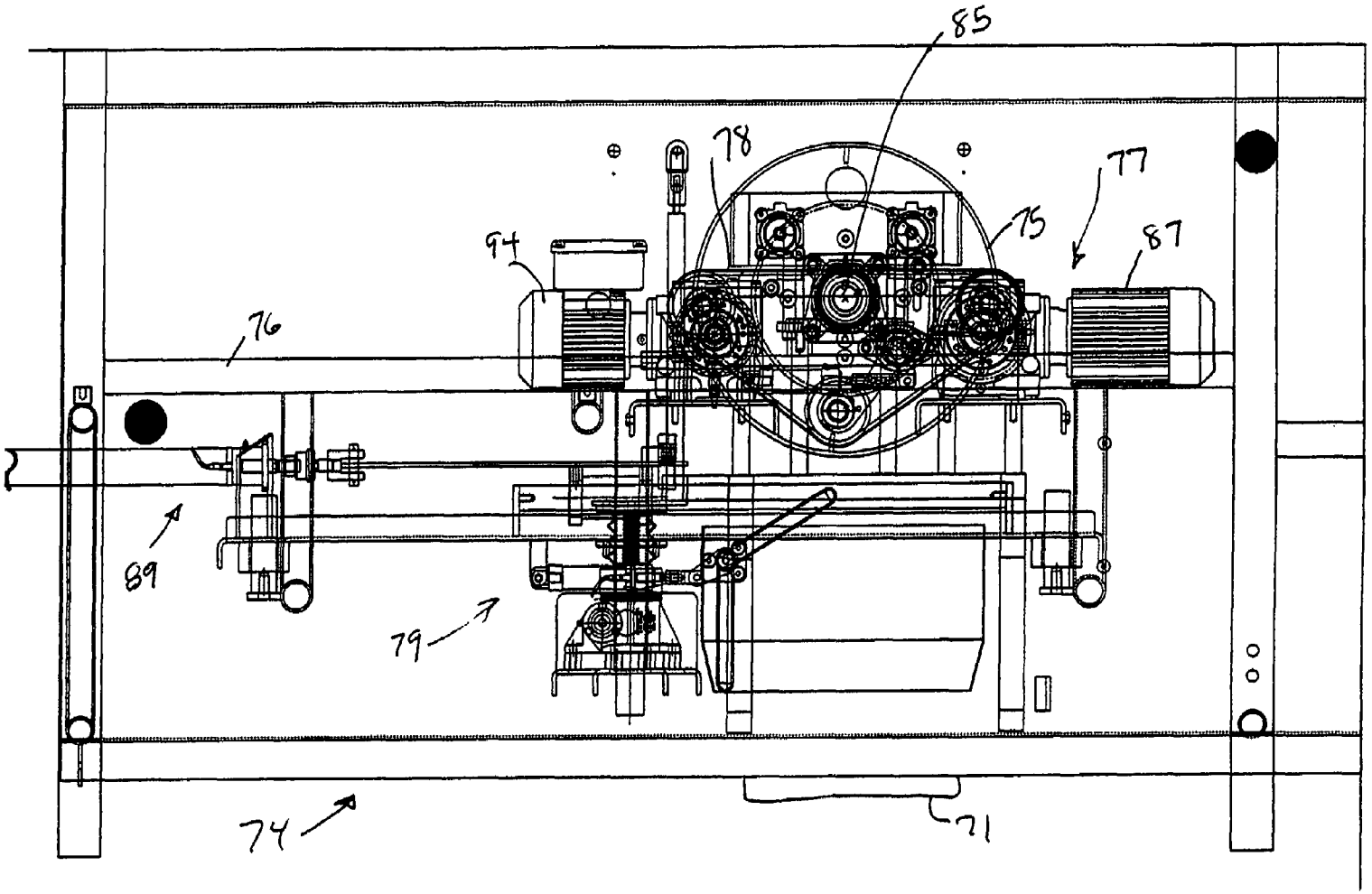
FIG. 19 is a detailed view of the block inverter and trim module similar to that of FIG. 6.
Figure 20:
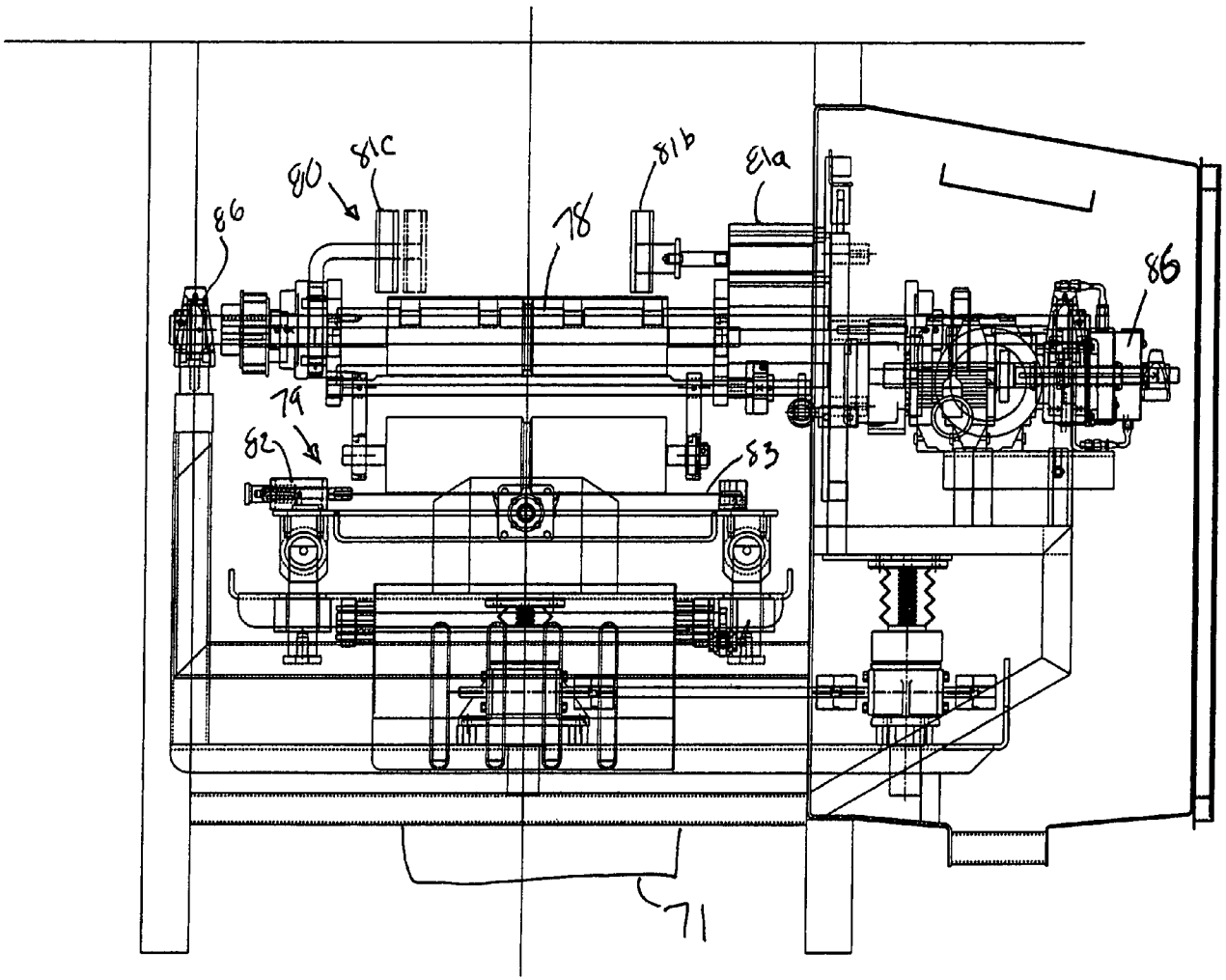
FIG. 20 is a detailed view block inverter and trim module similar to that of FIG. 7.

FIGS. 2A, 2B and 3, when arranged in side-by-side relation as shown in FIG. 17, provide a simplified representation of one implementation of the apparatus 70 provided by the present invention for performing the cheese block cutting operations described above with reference to FIG. 1. FIGS. 4A, 4B and 5, when arranged in side-by-side relation as shown in FIG. 18, provide a plan view of the apparatus 70 shown in FIGS. 2A, 2B and 3 and illustrate how the system can be arranged in practice. The apparatus is automated so that workstations for operators are not required. It is pointed out that in the simplified representation of the apparatus 70 shown in FIGS. 2A, 2B, 3, 4A, 4B and 5, and FIGS. 6-9, some of the components of the apparatus for cutting blocks of cheese or other food product into smaller portions, not required for illustrating the system and method of the present invention, have been omitted from FIGS. 2A, 2B, 3, 4A, 4B, 5 and 6-9 to simplify the drawings.

Infeed Stage

Referring to FIGS. 2A, 2B and 3 and to FIGS. 4A, 4B and 5, the infeed stage 21 includes a block staging conveyor 72 for receiving blocks 51 of cheese to be cut by the apparatus 70. By way of a non-limiting example, the block staging conveyor 72 can be a belt conveyor. The block staging conveyor 72 conveys the blocks 51 to the trim removal stage 22. By way of example, and without limitation, the block staging conveyor can hold eight forty pound blocks 51 or four eighty pound blocks.

Trim Removal Stage

Figure 6:
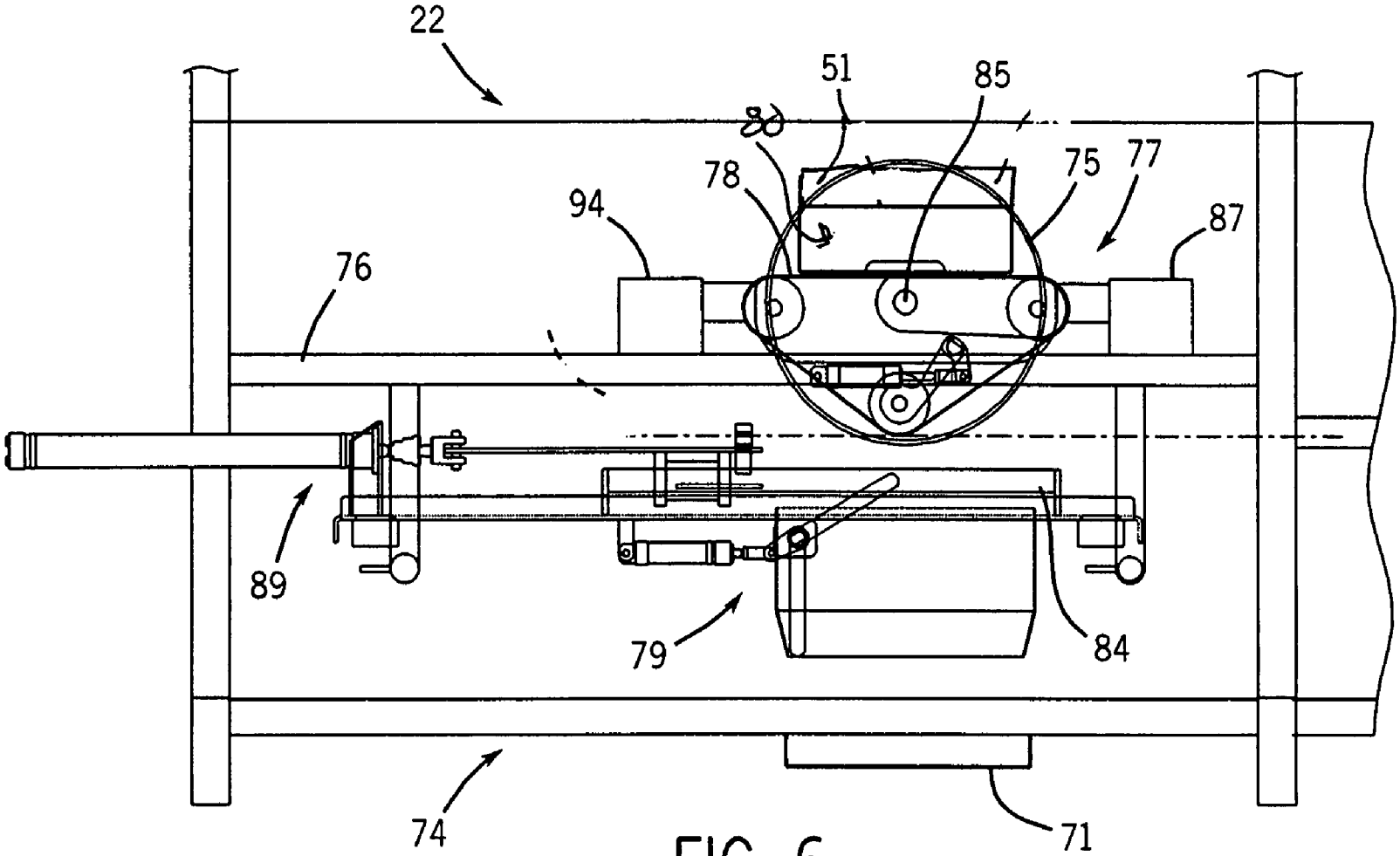
FIG. 6 is an enlarged view of the block inverter and top trim module of FIG. 2A, and showing the module in a position to receive a block.
Figure 7:
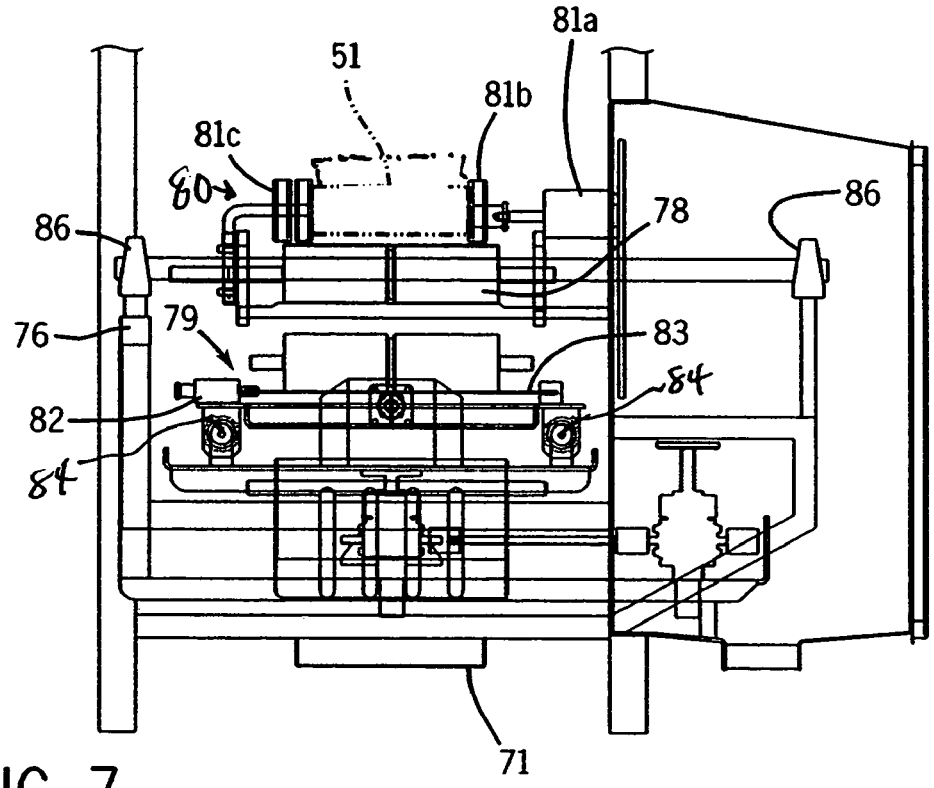
FIG. 7 is a section view, along the line 7-7 of FIG. 2A, and showing the module in a position to receive a block.
Figure 9:
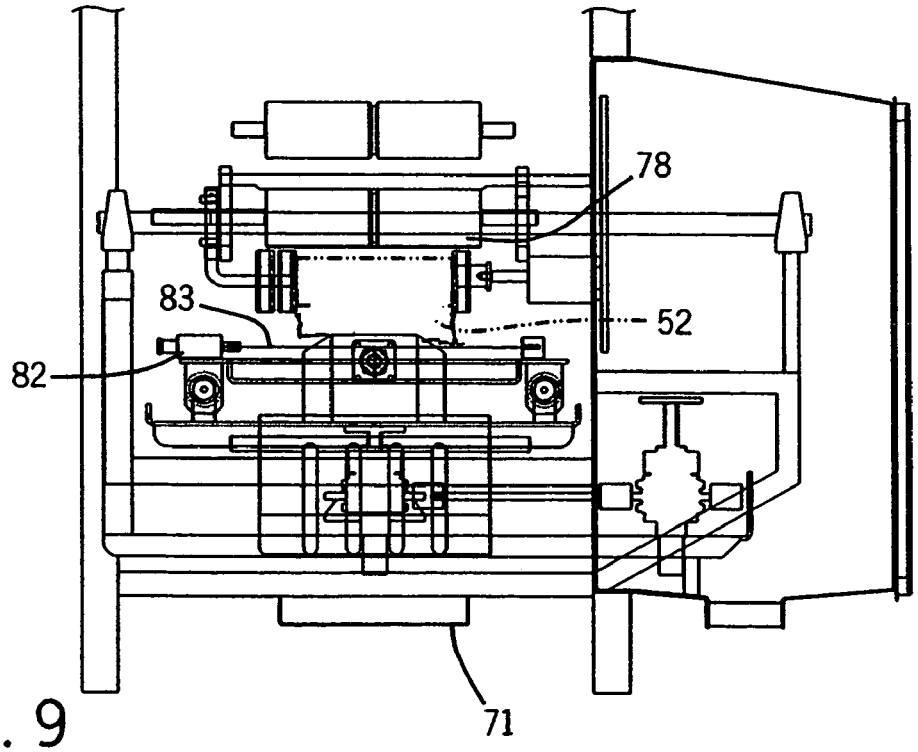
FIG. 9 is a section view taken along the line 9-9 of FIG. 4A, and showing the block inverter in an inverted position ready to cut the top trim.

Referring also to FIGS. 6, 7, 19 and 20, the trim removal stage 22 includes a trim removal module 74 that receives and holds a block 51 of cheese while cutting trim from the block 51, providing a trimmed block 52 (FIG. 9), and for rotating the block 51 during the cutting operation from an initial position shown in FIG. 7, where the block 51 is located in the conveying direction, to the rotated position shown in FIG. 9 where the upper portion of the trimmed block is aligned with an underlying trim pan 71. The trim removal module 74 includes a pivoting frame 75 that is pivotally mounted to a support frame 76 by a pivot mechanism 77. The pivoting frame 75 carries a trim module conveyor 78 and a block clamping assembly 80. The block clamping assembly 80 can include a pneumatically operated clamp drive mechanism for moving side clamping members inwardly into engagement with the untrimmed block 51 to hold the block of food product against movement while the block is being trimmed. A trim cutter assembly 79 is supported by the support frame 76.

The trim module conveyor 78 moves an untrimmed block, such as block 51 (shown on the staging conveyor 72), into the trim removal module 74. The trim module conveyor 78 is controlled to momentarily halt advancement of the untrimmed block 51 during the trim operation. The trim module conveyor 78 moves the trimmed block 52 out of the trim removal module 74, at the end of the trim operation. The trim module conveyor 78 can be a belt conveyor.

The block clamping assembly 80 (FIG. 7) includes a clamp drive mechanism 81A, a pair of side clamping members 81B and a clamping plate 81C. The clamping members 81B are located on one side of the trim module conveyor 78 for clamping a block 51 being trimmed during the trimming operation. The clamping plate 81C is located opposite the clamping members 81B on the opposite side of the trim module conveyor 78. The clamp drive mechanism 81A includes a pneumatically operated cylinder operable to press the clamping members 81B towards and into the block 51, pressing the block 51 into the clamping plate 81C. The clamping plate 81C has two mounting positions (one shown in phantom in FIG. 7), dependent on the orientation of the block 51 of food product being run. The clamp drive mechanism 81A is operated after an untrimmed block 51 has been moved into a trim cutting position within the trim removal module 74, where the block 51 to be trimmed is indexed with the trim cutter assembly 79.

The trim cutter assembly 79 includes a spring-tension wire 83 (FIG. 7) that is supported by a hasp or wire support carriage 82 that is fixed to the support frame 76, under the pivoting frame 75. The wire support of the wire support carriage 82 locates the cutting wire 83 near the top of the block 51 being trimmed. The wire support carriage is adjustable to allow the height of the cutting wire 83 to be adjusted to establish the height for a trimmed block 52 (from top to bottom) at a desired value. The wire support is adapted to be driven by an actuator mechanism 89, which can include a pneumatic cylinder, along guide rods 84 for moving the cutting wire 83 from a starting position, into and through a block 51 being trimmed, and to be returned to the starting position after the trim cut has been made.

Referring to FIG. 10, which is a simplified representation of the pivot mechanism 77, the pivot mechanism 77 includes a pivot shaft 85 on the pivoting frame 75, a pair of pivot journals 86 on the support frame 76 and a pivot drive mechanism 88 coupled to the pivot shaft 85 for rotating the pivoting frame 75 relative to the support frame 76, between the initial or conveying position and the rotated position. The pivot drive mechanism 88 can include a drive motor 87 mounted on the support frame 76 with a drive shaft coupled to the pivot shaft 85 for rotating the pivot shaft 85. The pivot drive mechanism 88 includes a gear motor 87 with a brake 91 and a positional tooth clutch 92. The output of the motor 87 is coupled to the pivot shaft 85 through a set of gears 93. The pivot shaft 85 is also the drive shaft for the trim module conveyor 78. To this end, the output of a further gear motor 94 is coupled to the pivot shaft 85 by a second clutch 95 which allows the trim module conveyor 78 to be disengaged from the pivot shaft 85, allowing the pivoting frame 75 to be rotated using the pivot drive mechanism 88. The pivot shaft 85 is coupled through a coupling mechanism 96 to a drive for the trim module conveyor 78. Alternatively, the drive mechanism can include a pneumatically-controlled actuator (not shown) that is coupled between the pivoting frame 75 and the support frame 76 when actuated, by extending and retracting a rod member of the actuator, the pneumatically-controlled actuator causes the pivoting frame 75 to be rotated, relative to the support frame 76, between the initial position and the rotated position.

Figure 8:
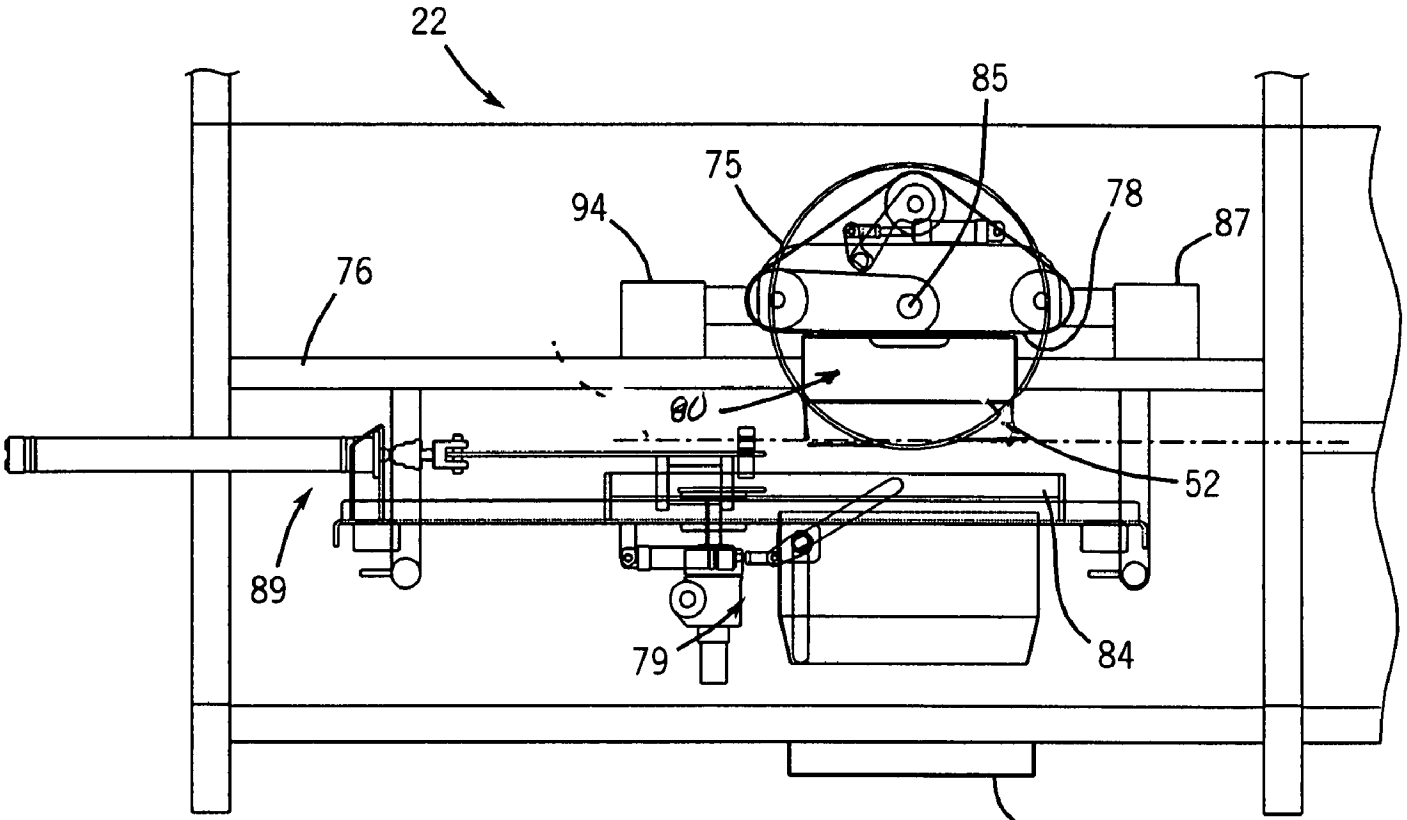
FIG. 8 is an enlarged view of the block inverter and top trim module of FIG. 2A and showing the block inverter in an inverted position ready to cut the top trim.

Reference is now made to FIGS. 8 and 9, which show the trimmed block 52 located rotated away from the initial or conveying position. Rotating the untrimmed blocks in performing the trim cutting operation allows the trim to drop into the trim pan 71 that is located beneath the trim removal module 74. Alternatively, a trim removal conveyor can be used to convey trim away from the block cutting apparatus 70 (FIG. 2A) for disposal.

In the preferred embodiment, the trim removal module 74 is dimensioned to receive and trim only forty pound blocks. Accordingly, when larger blocks, such as eighty pound blocks, are being cut, the trim operation is not carried out. Alternatively, the trim removal module 74 can be dimensioned to accommodate larger blocks.

First Cutting Stage

Referring to FIGS. 2A and 4A, the first cutting stage 23 includes a cutter module 100. The cutter module 100 includes a block holding or feed conveyor 101, a roller conveyor 102, a horizontal cutter 103 and a push block assembly 104.

The feed conveyor 101 is interposed between the trim removal module 74 and the roller conveyor 102. The feed conveyor 101 receives trimmed blocks, such as block 52, one at a time, from the trim removal module 74 and momentarily holds the trimmed blocks 52 prior to the block being advanced through the horizontal cutter 103. The feed conveyor 101 can be a belt conveyor. The cutter module 100 includes centering guides 105 located on opposite sides of the roller conveyor 102 for centering the block 52 on the roller conveyer 102 prior to the block 52 being pushed into the horizontal cutter 103. It is pointed out the block cutting process is a continuous process with blocks (and slabs after the blocks have been cut) being moved continuously through the apparatus 70.

However, to simplify the drawings, blocks (and slabs) are shown only at certain locations along the extent of the apparatus 70, and for example, a trimmed block (not shown) would be located on roller conveyor 102, stacks of slabs (not shown) would be located on conveyor 111, etc.

The horizontal cutter 103 can be a static cutter frame, commonly referred to as a harp cutter, having a plurality of horizontally and vertically-extending cutter wires or blades, such as horizontal cutter wires or blades 103 of the horizontal cutter 42 and a vertically extending cutter wire or blade 47, shown in FIG. 1. In the preferred embodiment, the horizontal cutter 42 includes three wires 103 for cutting trimmed blocks, such as block 52, into four slabs and a further wire 47 (not shown in FIGS. 2A and 4A) for cutting the stack of slabs vertically into two equal portions. However, fewer or more horizontal and/or vertical wires or blades can be used to make fewer or more than four slabs (or more stacks of slabs), depending upon the size of the blocks being processed and the size of the chunks to be produced. For example, the horizontal cutter can include two wires for cutting trimmed blocks into a stack of three slabs, with the wire 47 cutting the stack into two equal portions.

The push block assembly 104 can be conventional in nature and is adapted to push the block 52 through the horizontal cutter wires 103. The push block assembly 104 includes a push block 106, a push block support 107 that supports the push block 106 and a push block drive mechanism 108 that moves the push block support 107. The push block support 107 rides in a guide track 109. The push block drive mechanism 108 reciprocates the push block 106 within the horizontal cutter module 100 to move a block 52 of food product being cut through the horizontal cutter 103. The push block support 107 is driven to cause the push block 106 initially to be driven in the conveying direction, to push the block 52 into and through the horizontal cutter wires. Then, the push block mechanism 107, driven by the push block drive mechanism 108, raises the push block 106 upwards, and drives the push block 106, guided by the guide track 109, in a direction opposite to the conveying path 18, returning the push block 106 to a position overlying the starting position. The push block support, driven by the push block drive mechanism 108 then lowers the push block 106 to a position located behind the further block of cheese located on the feed conveyor 101 and the cycle repeats for driving the further block of cheese into the horizontal cutter.

Referring also to FIGS. 1, 2B and 3, the horizontal cutter 42 divides the block 52 into a plurality of slabs. In one embodiment, and by way of a non-limiting example, the blocks are cut horizontally into two stacks with one stack containing four slabs 34-37 and the other stack containing four slabs 38-41. The stacks of slabs are retained temporarily on a stack accumulation and infeed conveyor 111 (FIG. 2B) of the product destacking stage 24 until a product destacking module 110 of the product destacking stage 24 is ready for destacking the slabs. In accordance with a feature of the invention, two stacks 53 of slabs are destacked simultaneously during each destacking operation.

Product Destacking Stage

Referring to FIGS. 2B, 3 and 4B, the product destacking module 110 of the product destacking stage 24 includes the stack accumulation and infeed conveyor 111, a product destacking infeed conveyor 112, a slab separation conveyor 113, and a vacuum transfer apparatus 114 By way of a non-limiting example, the stack accumulation and infeed conveyor 111, the product destacking infeed conveyor 112, and the slab separation conveyor 113 can be belt conveyors.

Referring also to FIG. 11, the vacuum transfer apparatus 114 includes a pneumatic transfer plate assembly 115 and a drive mechanism 116 for positioning the pneumatic transfer plate assembly 115 during product destacking operations. The pneumatic transfer plate assembly 115 includes a single pneumatic transfer plate 117, generally rectangular in shape and having two sets of three vacuum cups 118. The vacuum cups are disposed to have the three vacuum cups 118 of one set overlying the four corners of one of the stacks of slabs that are being destacked and to have the three vacuum cups 118 of the other set overlying the other stack of slabs being destacked.

The drive mechanism 116 is mounted for reciprocating movement along a track 119 to move the pneumatic transfer plate assembly 115 between a home or starting position in which the pneumatic transfer plate assembly 115 overlies the stacks being destacked and a product centering position in which the pneumatic transfer plate assembly 115 overlies the slab separation conveyor 113. In addition, the drive mechanism 116 is adapted to raise and lower the pneumatic transfer plate assembly 115 at the home or starting position and the product centering position as will be shown.

When eighty pound blocks are cut, a second embodiment/configuration is designed to handle the larger cheese blocks.

Product Holding Stage

With continued reference to FIGS. 2B, 3 and 5, the product holding stage 25 includes a product holding conveyor 120 that temporarily holds slabs 57 coming from the product destacking module 110 and then conveys the slabs 57 to the product centering stage 26. The product holding conveyor 120 is interposed between the slab separation conveyor 113 and a product centering conveyor 122 of the product centering stage 26. The product holding conveyor 120 receives slabs 57 from the slab separation conveyor 113 and supplies the slabs 57 to the product centering conveyor 122.

Product Centering Stage

With continued reference to FIGS. 3 and 5, the product centering conveyor 122 of the product centering stage is interposed between the product holding conveyor 120 and a vertical cutting module 130 of the second cutting stage 27. The product centering conveyor 122 receives slabs 57 from the product holding conveyor 120, centers the slabs and transfers the slabs to the vertical cutting stage 27. The product holding conveyor 120 and the product centering conveyor 122 can be belt conveyors.

Vertical Cutting Stage

Referring to FIGS. 3 and 5, the vertical cutting module 130 of the second cutting stage 27 includes a vertical or transverse cutter 134, an infeed conveyor 136 and a hold-down conveyor 138. The infeed conveyor 136, which can be a belt conveyor, receives slabs 58 from the product centering conveyor 122 and conveys the slabs 58 to the hold-down conveyor 138. The hold-down conveyor 138 grips each slab 58 presented thereto, advances the slab 58 through the transverse cutter 134. The hold-down conveyor 138 can be of conventional design, including drive belts located above and below a slab 58 being cut for engaging the top and bottom surfaces of that slab 58. The separation between the height of the hold-down conveyor 138 is set to hold the height of the slabs 58.

The transverse cutter 134 can include a guillotine cutter that is configured to make cuts transversely of the slab, that is, perpendicular to the processing path. Preferably, the transverse cutter 134 is an ultrasonic type cutter having an ultrasonic cutting head. The transverse cutter 134 makes a plurality of transverse cuts in the two slab halves simultaneously, forming a plurality of sets 50 of chunks in succession. The chunks 50A and 50B of each set are disposed in-end-to-end relation. Thus, each operation of the transverse cutter 134 separates a set 50 of chunks 50A and 50B from the slab portions being cut, four sets in the example, and the chunks 50A and 50B of the sets are advanced to a chunk orientation conveyer 140 of the product denesting stage 28 where the chunks 50A and 50B are moved on downstream. The hold-down conveyor 138 continuously advances the slab 58 being cut. The product of the vertical cutting module 130 is a succession of transversely-oriented sets of chunks 50A and 50B of cheese moving in the downstream direction of the block cutting system. After the transverse cutter 134 has made its cut, chunks 50A and 50B fall forward onto a pivoting reject conveyor. The pivotal reject conveyor's normal position is horizontal, discharging product 50A and 50B onto the chunk orientation conveyor 140. Known miss-weight chunks 50A and 50B will be rejected by pivoting downward the reject conveyor into a tote for disposal.

Product Denesting Stage

With continued reference to FIGS. 1, 3 and 5, in the product denesting stage 28, the chunks 50A and 50B (FIG. 1) cut by the transverse cutter 134 are advanced by the chunk orientation conveyor 140 past a turning belt 142 that is positioned immediately downstream of the transverse cutter 134. The turning belt 142 turns the transversely oriented chunks 90' as the chunks 50A and 50B of each set are being conveyed by the chunk orientation conveyor 140 to a chunk separation conveyor 144 of the portion accumulation stage 29. The chunk orientation conveyor 140 and the chunk separation conveyor 144 can be belt conveyors.

Separation and Counting Stage

With reference to FIGS. 1, 3 and 5, in the portion accumulation stage 29, the transversely-oriented sets 50 of portions are conveyed by the chunk orientation conveyor 140 to the chunk separation conveyer 144 to be brought into uniform spacing according to the demands of the packaging machine being used. Specific techniques for separating and counting individual portions are known per se. The illustrated embodiment shows the chunks 50A and 50B being conveyed in a single file. However, the chunks can be guided into more than one parallel file if the packaging machine will accept such an input.

The right-hand side of FIG. 1 shows the chunks 50A and 50B undergoing orientation into a single evenly-spaced file for feed to an automated packaging machine. The automated packaging machine can be conventional and accordingly, is not described in detail herein.

Specific techniques for aligning, orienting and spacing individual portions are known per se, for example by subjecting the oncoming sets of chunks 50 to the action of the turning belt 142 and the chunk separation conveyer 144 illustrated in FIG. 3 and/or deflecting conveyers, and the details are not germane to the general proposals herein. The illustrated embodiment shows the chunks 50A and 50B being reduced to a single file and eventually being spaced apart from one in the conveying direction 18. The chunks can, however, be guided into more than one parallel file if the packaging machine will accept such an input.

Controller

Referring to FIGS. 2A, 2B and 3, control functions and operations of the apparatus 70, including the sequencing of the conveyors 72, 78, 101, 111, 112, 113, 120, 122, 136, 138, 140 and 144, the operation of the trim removal module 74, the operation of the product destacking module 110 and the operation of the transverse cutter 134, for example, can be synchronized by a computerized control system such as a microprocessor or a programmable logic controller represented by block 147 in FIG. 3. The microprocessor can have an associated touch screen control panel 148 to allow monitoring of and/or changing of operating conditions for the apparatus 70.

Process Flow Operation and Timing

Block Infeed and Trim Cutting

FIG. 12 is a process flow diagram illustrating the process for cutting blocks of cheese or other food product in accordance with the present invention. Referring to FIGS. 2A, 2B, 4 and 12, process step 151 is the staging operation 21 in which blocks 51 to be cut are placed on the infeed or block staging conveyor 72 and moved into the trim removal module 74. The operation of the infeed or block staging conveyor 72 is synchronized with the operation of the rotating trim removal module 74. The infeed or block staging conveyor 72 feeds a block 51 to the trim removal module 74 and is then paused while trim is being cut from the block 51.

Referring also to FIGS. 6, 7 and 10, initially, the drive motor 94 is coupled to the pivot shaft 85 which, in turn, is coupled to the trim module conveyor through coupling 96 for advancing the trim module conveyor 78. The pivot drive motor 87 is decoupled from the pivot shaft 85. In process step 152, which corresponds to the trim removal stage 22, the untrimmed block 51 is conveyed into the trim removal module 74, in stage 22, and onto the trim module conveyor 78 which is advanced to locate the block 51 in alignment with the trim cutter assembly 79. The drive motor 94 is decoupled from the pivot shaft 85 to temporarily halt advancement of the trim module conveyor 78. The clamp drive mechanism 81A of the block clamping assembly 80 is activated to move the clamping members 81B into engagement with the sides of the block 51, pushing the block 51 into engagement with the clamping plate 82C to secure the block to the pivoting frame 75. Then, the clutch 92 is disengaged, allowing the pivot drive motor 87, through gears 93 to rotate the pivoting frame 75 from the home position, shown in FIG. 7, to the rotated position, shown in FIG. 9. The wire cylinder drive 89 is activated to cause the cutting wire 83 to be driven into and through the upper portion of the block (which is now inverted) for cutting trim 32 from the block. In accordance with the invention, the pivoting frame 75 is rotated through an angle of about 180° during the trim cutting operation to allow the trim to drop into the trim pan 71 (FIG. 9) for subsequent disposal. The pivot motor drive 87 is reversed to return the pivoting frame 75 and the now trimmed block 52 back to the original or conveying position (FIG. 7) so that the trimmed block 52 is prepared to be conveyed in the conveying direction.

When the pivoting frame 75 has rotated the trimmed block 52 back to the conveying position, the clutch 92 is engaged, the clamping members 81B are released, and the drive motor 94 is coupled to the pivot shaft 85 for advancing the trim module conveyor 78. The trim module conveyor 78 and the infeed or block staging conveyor 72 are advanced at the same time to move the trimmed block 52 out of the trim removal module 74 and to move the next block 51 to be trimmed into the trim removal module 74. The trim module conveyor 78 moves the trimmed block 52 to the feed conveyor 101 at the input of the horizontal cutting stage 23.

Block Horizontal Cutting

Referring to FIGS. 2A, 2B, 4 and 12, in the horizontal cutting stage 23, the feed conveyor 101 conveys the trimmed block 52 onto the roller conveyor 102 where the block 52 is centered by centering guides 105 in process step 153. In process step 153, at the home or starting position, shown in FIG. 2A, the centering guides 105 center the block 52 prior to the block 52 being pushed into the horizontal cutter 103. In process step 154, the block is cut horizontally and vertically. From the starting position, shown in FIG. 2, the drive mechanism 108 causes the push block support 107 to advance the push block 106 to drive the trimmed block 52 into and through the horizontal cutter 103 (towards the right in FIG. 2A). When the push block 106 reaches end of travel, the push block support 107 driven by the drive mechanism 108 raises the push block 106 upwardly and moves the push block 106 back to the starting position, where the push block 106 is located behind the next block to be cut by the horizontal cutter 103. The push block support 107 holds the push block 106 above the feed conveyor 101 until there is room on the feed conveyor 101 for the block about to be cut. At such time, the drive mechanism 108 causes the push block support to lower the push block 106 down near the conveyor into position behind the next trimmed block to be cut. The drive mechanism 108 then moves the push block support 107, moving the push block 106 forwardly into engagement with the next trimmed block to be cut. The above cycle repeats with the push block 106 being driven to move the second block into and through the horizontal cutter 103.

Referring also to FIGS. 2B and 3, the operation of the push block assembly 104 is synchronized with the operation of the product destacking module 110. When one stack of slabs has been moved onto the stack accumulation and infeed conveyor 111, the pusher mechanism waits until completion of the destacking operation for the previous stack of slabs before cutting further blocks.

In one embodiment, the push block 106 is positioned at a starting position behind the block 52 of cheese and is advanced, pushing the block 52 into and through the horizontal cutter 103. As the block 52 is being pushed through the horizontal cutter 103, a further trimmed block (not shown) is being moved from the output of the trim removal module 74 onto the feed conveyor 101. When the block 52 has been pushed through the horizontal cutter 103, the push block 106 is raised up and returned to the starting position and lowered to be located behind the further block of cheese located on the feed conveyor 101. Each stack of slabs is advanced to the stack accumulation and infeed conveyor 111 as the stack of slabs is cut.

Product Destacking

Referring to FIGS. 2B, 5 and 12, in process step 155, which corresponds to the product destacking stage 24, the product destacking module 110 receives and destacks a stack of slabs being held on the stack accumulation and infeed conveyor 111. The vacuum transfer apparatus 114 is used to destack the slabs, in pairs, with the product destacking infeed conveyor 112 and the slab separation conveyor 113 being used to move individual slabs within and out of the product destacking module 110.

Figure 13:
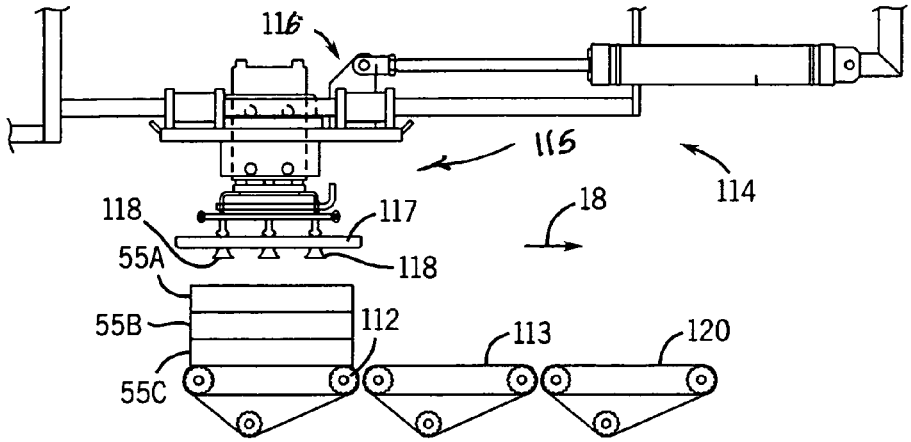
FIGS. 13-16 are views showing steps in the operating sequence of a destacking module of the apparatus of FIG. 2.
Figure 14:
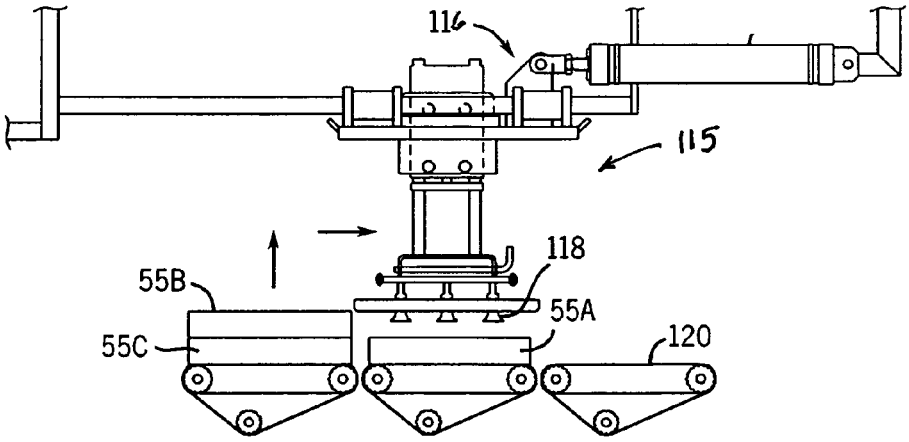
Figure 15:
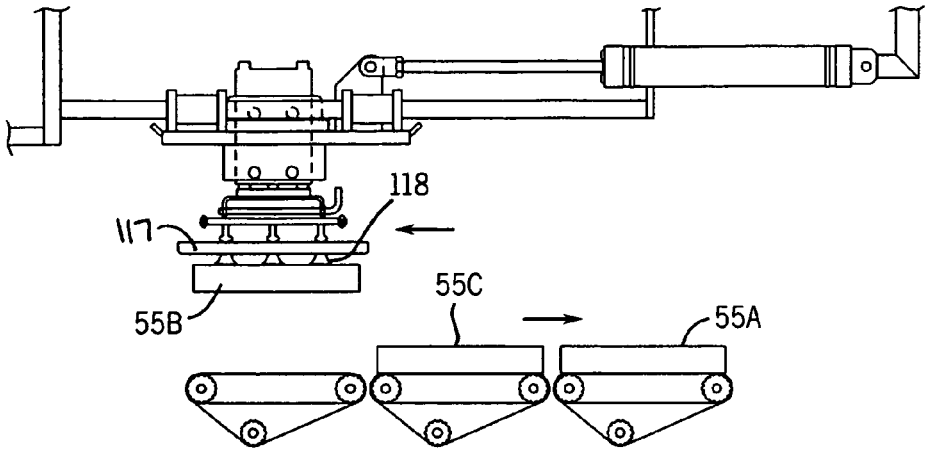
Figure 16:
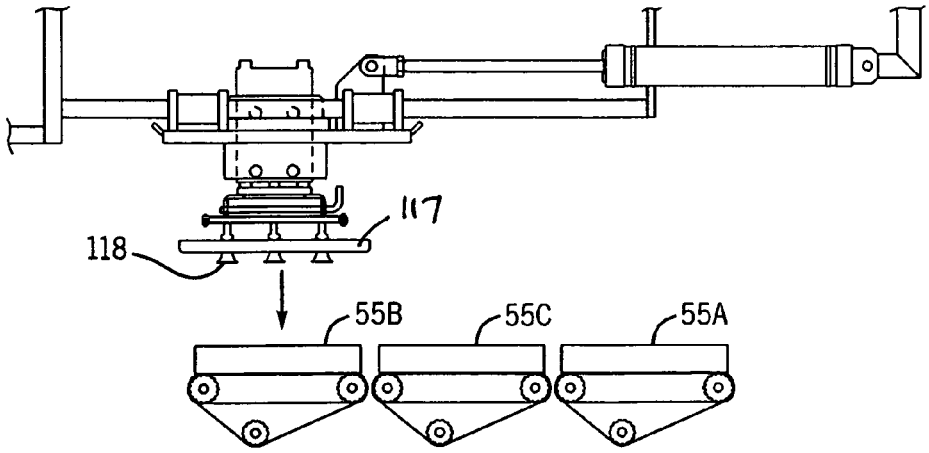

Referring also to FIGS. 13-16, the destacking operation is described with reference to an example in which three transfer operations are used to simultaneously destack a stack of three slabs. In FIG. 13, a stack of three slabs 55A, 55B and 55C is positioned on the product destacking infeed conveyor 112, underlying the vacuum transfer apparatus 114. The first, or top slab 55A, is removed from the stack of slabs vertically by the vacuum transfer apparatus 114. The slab, attached to the vacuum transfer apparatus 114 which is powered in a forward direction 18 relative to the process path to a position overlying the slab separation conveyor 113. The slab 55A is lowered by the vacuum transfer apparatus 114 and released onto the slab separation conveyor 113, as shown in FIG. 14. The vacuum transfer apparatus 114 is returned to a position overlying the slab 55B. The vacuum transfer apparatus 114 lowers, the vacuum is engaged, and the vacuum transfer apparatus picks up the slab 55B, clear of the slab 55C. The slab 55C, still resting on the product destacking infeed conveyor 112, is moved forward to the slab separation conveyor 113 and the slab 55A moves forward, along the process path 18 to the product holding conveyor 120 as shown in FIG. 15. The vacuum transfer apparatus 114 then lowers the slab 55B onto the now empty product destacking infeed conveyor 112 as shown in FIG. 16. These slabs 55A, 55C and 55B are then transferred in succession to the product holding stage 25 for subsequent transfer to the vertical cutting stage 27. It is pointed out that the foregoing example, described with reference to FIGS. 13-16, illustrates the destacking of a single stack of slabs that includes only three slabs. A similar destacking sequence can be used for destacking a stack including only two slabs, such as slabs 55B and 55C. In such sequence, slab 55B can be raised up over slab 55C, which is then advanced, and slab 55B returned to the now empty destacking infeed conveyor 112. Similarly, for a stack including four slabs, such as slabs 55A, 55B, 55C and a further slab (not shown), the further slab can be removed from the stack and placed on conveyor 113 ahead of the stack of slabs, in the manner 55A, and the remaining slabs 55A-55C can be destacked in the manner described above with reference to FIGS. 13-16. Moreover, in all three cases, more than one stack can be destacked simultaneously, with two or more stacks disposed in side-by-side relation, in the manner shown for slabs 34-37 and 38-41 in FIGS. 1-9, for example.

Product Holding and Transfer

Referring to FIGS. 3, 5 and 12, in step 156, the slabs being conveyed out of the product destacking module 110 on a product holding conveyor 120 are moved to a product centering conveyor 122 in the product holding stage 26. The product holding conveyor 120 can hold two slabs when forty pound blocks are being processed. However, when larger size blocks, such as eighty pound blocks, are being cut, the product holding conveyor 120 can hold only one slab.

Slab Vertical Cutting

Referring to FIGS. 3, 5 and 12, in process step 157, the slabs 57 are transferred by the product centering conveyor 122 to the vertical cutting module 130, in the vertical cutting stage 27, and held by the hold-down conveyor 138 which moves the slabs through the vertical cutting module 130. The slab portions 58A and 58B are conveyed to the transverse cutter 134 which, by way of example, cuts the two slab portions 58A and 58B into four chunk pairs 50. However, the transverse cutter 134 can set to cut the slab portions into other numbers of chunk pairs, depending upon application.

By way of example, the transverse cutter 134 operates continuously in a three count sequence to cut each pair of slab portions 58A and 58B into four sets of chunk portions, with the hold-down conveyor 138 continuously moving slab portions past the transverse cutter 134. The operation of the transverse cutter 134 is paused briefly after a slab has been cut, to allow the hold down conveyor to index the next slab into proper position with respect to the transverse cutter 134 before cutting of that slab is initiated. The product of the vertical cutting system is a succession of transversely-oriented sets of chunks of cheese or other food product moving in the downstream direction of the system which, as shown, operates entirely in-line. In the product denesting stage 28, the chunks cut by the transverse cutter 134 are advanced by the chunk orientation conveyor 140 to the alignment and separation conveyer 144 positioned immediately downstream of the chunk orientation conveyor 140.

Thus, as the slab portions 58A and 58B are conveyed past the transverse cutter 134, each operation of the transverse cutter 134 separates a set 50 of chunks, four sets in the example, from the slab portions, and the chunks 50A and 50B of each set are moved by the slab (chunk) orientation conveyer 140 onto the separation and alignment conveyer 144 which moves the chunks on downstream.

Product Denesting and Separation

In process step 158, the chunk pairs 50 being outputted by the vertical cutting module 130 are turned by the turning belt 142 to be advanced in a single file orientation. The turning belt 142 turns the transversely oriented chunks 90° as the chunks 50A and 50B of each set are being conveyed by the chunk orientation conveyor 140 to the chunk separation and alignment conveyor 144. In step 159, which corresponds to the portion accumulation stage 29, the chunk pairs 50 are separated by separation conveyor 144 into separate chunks and the separate chunks 50A and 50B are counted prior to packaging.

It may therefore be appreciated from the above detailed description of the preferred embodiment of the present invention that it provides a continuous, in-line block cutting system for cutting blocks of a food product, such as cheese, into smaller portions, suitable for retail packaging. The system includes a longitudinal cutter that cuts the blocks longitudinally to provide a stack of slabs which are destacked by a vacuum transfer apparatus. A transverse cutter cuts the individual slabs to create chunks of cheese or other food product. The conveyors include a stack conveyor located in the processing path for conveying successive stacks of slabs from the longitudinal cutter to the product destacking apparatus in succession, and a slab conveyor located in the processing path for conveying successive slabs from the product destacking apparatus to the transverse cutter. A trim cutting module includes a rotating mechanism that rotates a block as it is being trimmed, allowing trim to drop to a trim disposal conveyance.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A method for cutting blocks of cheese or other food product into chunks, said method comprising:

conveying the blocks of the food product along a processing path in a plane for cutting the blocks;

cutting trim from the block, wherein the trim cutting step includes the steps of rotating the block about an axis in the plane that extends perpendicular to a conveying direction from a conveying position to a trimming position and, rotating the block from the trimming position back to the conveying position after trim has been cut from the block;

after cutting trim from the block, making one or more longitudinal cuts in a block to create at least one stack including a plurality of slabs of the product;

conveying the stack of slabs to a vacuum transfer apparatus;

using the vacuum transfer apparatus to destack the stack of slabs to provide a plurality of individual slabs, including controlling the vacuum transfer apparatus to successively lift slabs from the stack for transfer to a slab separation conveyor;

conveying the individual slabs in succession from the slab separation conveyor to a slab cutting system that includes a transverse cutter; and using the slab cutting system for cutting the individual slabs to create the chunks of the product.

2. The method according to claim 1, wherein the step of making one or more longitudinal cuts in the block includes the steps of cutting the block horizontally and vertically to form a plurality of slabs of the product disposed in a plurality of stacks, and conveying the plurality of stacks of slabs to the vacuum transfer apparatus.

3. The method according to claim 1, wherein the step of making one or more longitudinal cuts in the block includes the steps of cutting the block longitudinally to divide the block into a plurality of slabs forming a stack of slabs.

4. The method according to claim 3, wherein the step of destacking the slabs includes the step of simultaneously destacking a plurality of stacks of slabs during the destacking operation.

5. The method according to claim 4, wherein the step of conveying the stack to the vacuum transfer apparatus includes the steps of accumulating a plurality of stacks of slabs on a stack accumulator and infeed conveyor at an input of the vacuum transfer apparatus, and advancing the stack accumulator and infeed conveyor to move the plurality of stacks into the vacuum transfer apparatus for simultaneous destacking of the plurality stacks.

6. The method according to claim 1, wherein the step of cutting trim from the block further includes the step of moving a trim cutting wire into and through the block after the block has been rotated to the trimming position.

7. The method according to claim 1, wherein the step of rotating the block from a conveying position to a trimming position includes the step of rotating the block through an angle of about 180° about an axis that extends perpendicular to the conveying direction.

8. The method according to claim 1, wherein the step of using the slab cutting system for cutting the individual slabs includes the step of making a plurality of transverse cuts in the slabs successively to form successive sets of chunks.

* * * * *